US005613838A

United States Patent [19]

Newell

[11] Patent Number: 5,613,838

[45] Date of Patent: Mar. 25, 1997

[54] ROTARY PISTON FLUID HANDLER

[76] Inventor: Kenneth J. Newell, 26500 W. Agoura Rd., #444, Calabasas, Calif. 91302

[21] Appl. No.: 544,895

[22] Filed: Oct. 18, 1995

[51] Int. Cl.[6] ..... F04B 1/20

[52] U.S. Cl. ..... 417/269; 92/57; 91/197; 91/502; 91/507

[58] Field of Search ..... 417/269, 460, 417/462; 92/57; 91/197, 499, 502, 507

[56] References Cited

U.S. PATENT DOCUMENTS

| | | | |
|---|---|---|---|
| 666,690 | 1/1901 | Pickles | 91/507 |
| 825,387 | 7/1906 | Hanscom | 91/507 |
| 1,742,088 | 12/1929 | Maxson . | |
| 1,804,921 | 12/1925 | Ellyson . | |
| 2,614,540 | 10/1952 | Morton | 91/502 |
| 3,302,528 | 2/1967 | Rosenhaft | 92/57 |

*Primary Examiner*—John J. Vrablik
*Assistant Examiner*—William Wicker
*Attorney, Agent, or Firm*—Terrell P. Lewis

[57] ABSTRACT

A pump apparatus includes an outer cylindrical housing having end plates, and a power conversion assembly supported for rotation within the outer housing. A torque input shaft provided on one of the end plates has a "primary" gear on its free end. The inner housing includes a crank case within which cylinders are arranged at spaced radial locations. Double-acting pistons are housed within the cylinders. Crank members supported by the crank case for rotation are coupled to the pistons via force transmitting elements to drive the pistons with reciprocating motion in the cylinders. Each of the crank members includes a "secondary" gear engaged with the primary gear. Each crank member includes a linkage coupled with a piston rod so that the pistons are driven in reciprocating motion in the cylinders. Both ends of the pistons communicate with fluid reservoirs, and the motion of the pistons causes the fluid to be moved into or out of the cylinders in response to the direction of motion of the pistons in the cylinders.

16 Claims, 3 Drawing Sheets

FIG. 1
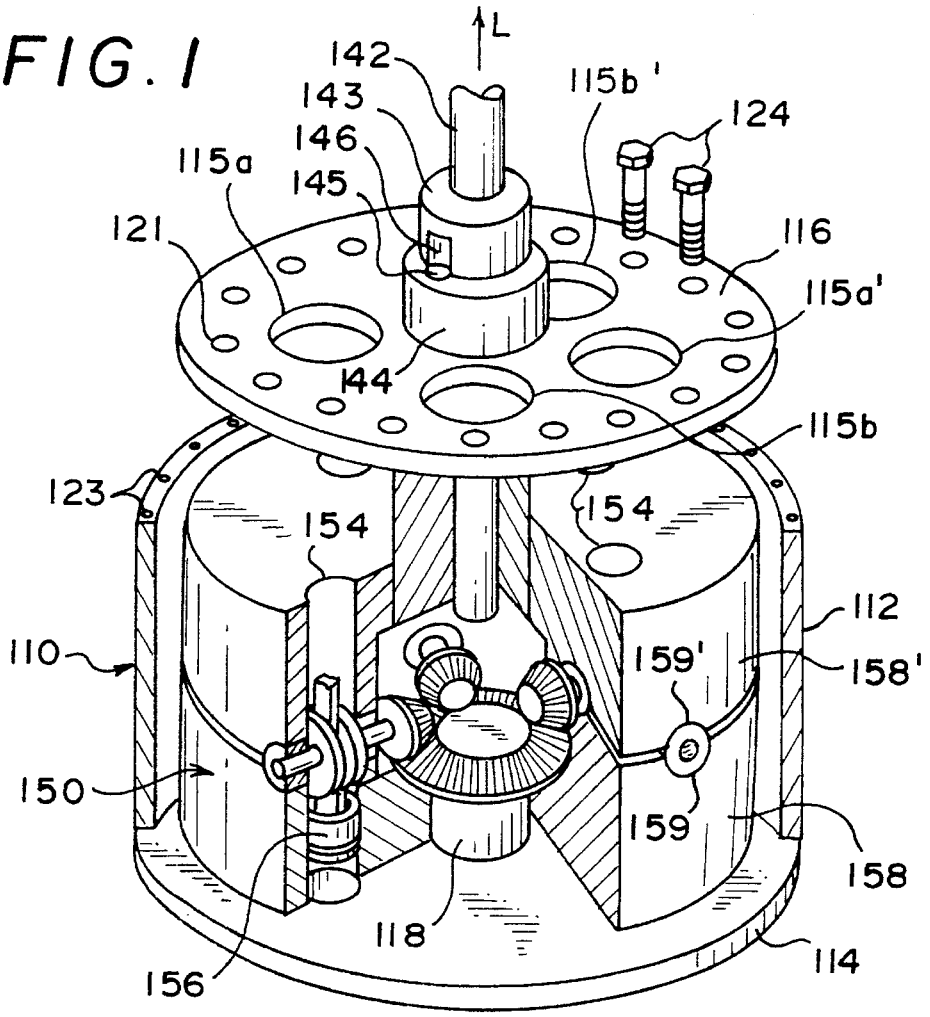
FIG. 6
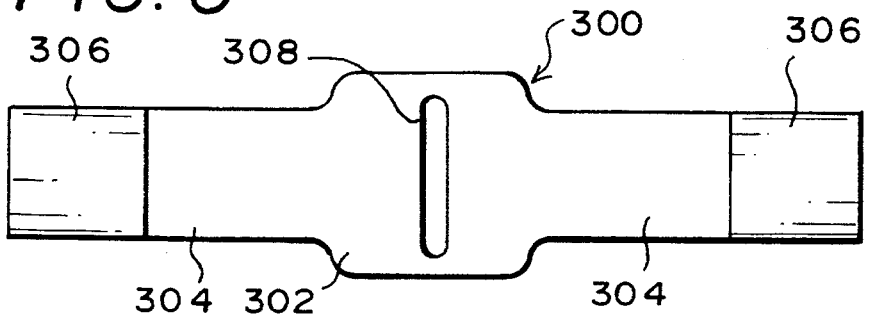
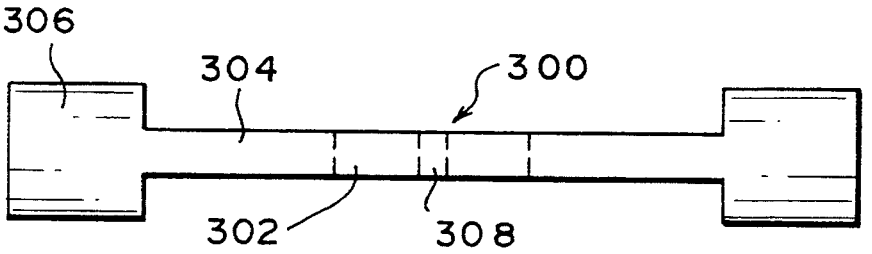
FIG. 7

ROTARY PISTON FLUID HANDLER

BACKGROUND OF THE INVENTION

1. Field of the Invention

The present invention relates to piston driven fluid handlers, and more particularly to pumps and motors having reciprocating pistons supported in a rotating housing and coupling elements for selectively converting movements of the pistons and the housing into work.

2. Background of the Invention

It is known in the prior art to provide a sinusoidal track or cam in a housing wall to impart a like motion to pistons disposed in cylinders mounted in the housing. The track, pistons and cylinders most often find their greatest utility in pumps and motors.

However, in such devices, there are significant drawbacks. For example, with the use of a sinusoidal track to induce axial translations of pistons by means of rotational torque applied at the shaft, the resultant normal force acting on the cam following mechanism requires additional trigonometric reduction to attain an axial force parallel to the axis of piston translation.

Corollary to the application of torque to obtain axial motion is the use of cylinder cavity gas expansion (i.e., an engine cycle) to induce axial force such that, by means of the cam following mechanism, torque results. The resultant torque is only a fraction of what would be produced had the same axial force been applied perpendicular to the output axis of rotation. Again, by necessity, the trigonometric reduction in resultant normal force to attain a perpendicular component of force to the axis of output rotation effectively limits the utility of such designs.

Such prior designs are also prone to component failure, as a result of excess wear due to the inefficient conversion of torque to axial forces, or a similar inefficient conversion of axial forces to torque.

And in these prior designs, the cost of manufacture is extremely high, since the production of sinusoidal cams and cam slots requires off-axis milling.

Against this background, it would be desirable to have a rotary power apparatus which would convert the linear, reciprocating motion of the pistons into optimum output work without using a sinusoidal cam slot with a cam follower.

OBJECTS AND SUMMARY OF THE INVENTION

It is therefore an object of the present invention to provide a novel pump or motor apparatus or converting reciprocating motion of pistons into rotary output motion without coupling the reciprocating motion and rotary motion through sinusoidal cam components and cam followers, and which will overcome all the deficiencies and drawbacks of similar systems currently known.

Another object of the present invention is to provide a novel pump or motor having significantly fewer components than the currently known similar motors by which rotary power can be developed and transmitted by linearly moving pistons to a power output shaft of the pump or motor.

Yet another object of the present invention is to provide a pump or motor in which excess wear, and hence component failure, is significantly diminished in comparison to other pumps or motors currently known.

Still another object of the invention is to provide a pump or motor which can be fabricated without using off-axis milling equipment to cut or form sinusoidal cam tracks.

These and other objects are attained by the apparatus of the present invention which includes an outer cylindrical casing having end plates, and a power conversion assembly supported for rotation within the outer casing. One end plate includes a longitudinally extending shaft having a "primary" gear on its free end extending into the outer casing. The other ends plate includes an input shaft. Both end plates include two intake and two exhaust ports.

The power conversion assembly includes a crank case within which piston cylinders and double-acting pistons are housed. Crank members supported by the crank case are coupled to the pistons to drive the latter with reciprocating motion in the cylinders. Each of the crank members includes a "secondary" gear designed for complementary engagement with the primary gear on the end plate shaft.

In a first embodiment, an external source of rotational power is coupled to the power conversion assembly through the shaft in the other end plate. The power conversion assembly is driven in rotation within the housing. The secondary gears engage the primary gear and the crank members are caused to rotate.

Each crank member includes a linkage coupled with a piston rod so that the pistons are driven in reciprocating motion in the piston-containing cylinders. Both ends of the pistons communicate with fluid reservoirs through the intake and exhaust ports, and the motion of the pistons causes the fluid to be moved into or out of the cylinders in response to the direction of motion of the pistons in the cylinders.

BRIEF DESCRIPTION OF THE DRAWINGS

FIG. 1 is a perspective exploded view of the outer housing and inner power conversion assembly of the present invention, shown in partial section;

FIG. 6 is a plan view of the piston used in the power conversion unit of the present invention;

FIG. 7 is a side view of the piston shown in FIG. 6;

DETAILED DESCRIPTION OF THE INVENTION

Figure 2:
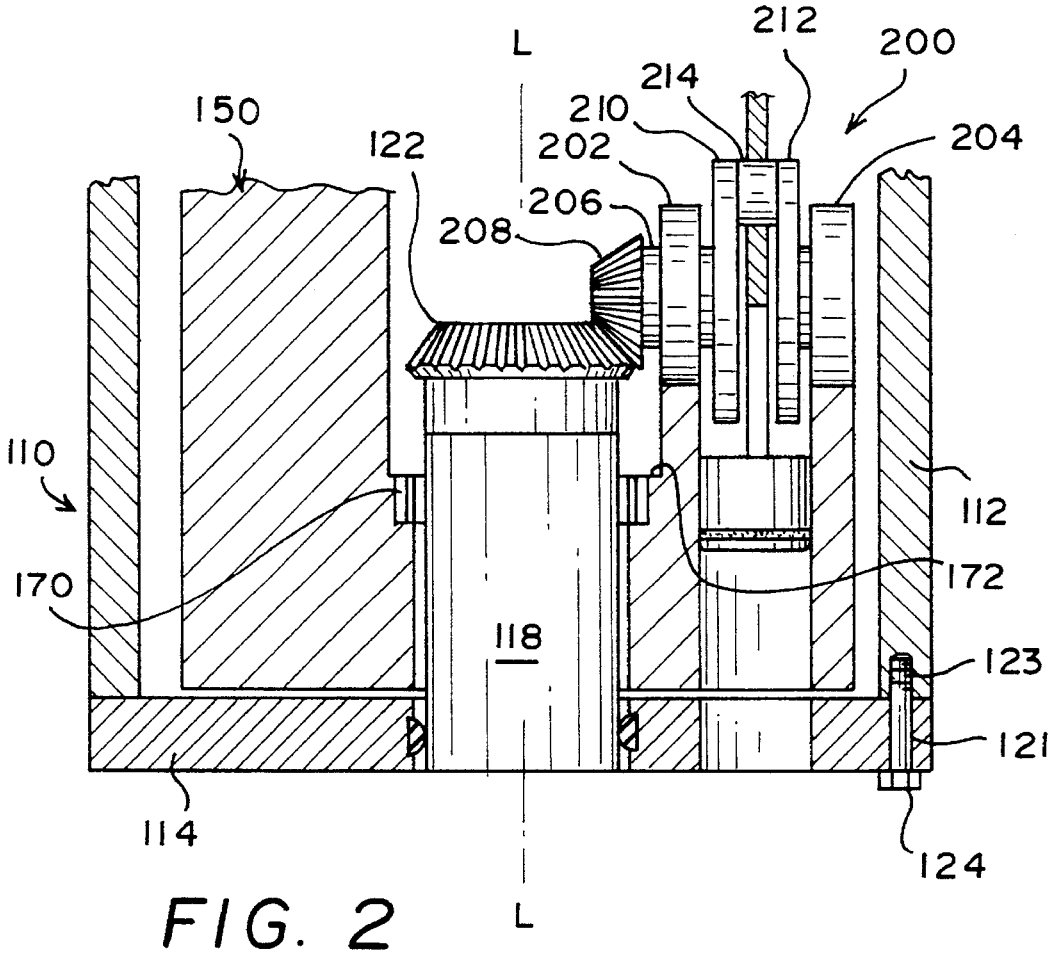
FIG. 2 is a cross-sectional view of the crank case assembly looking at an opening in which a crank member is supported.

The following detailed description is of the best currently contemplated modes of carrying out the invention. The description is not to be taken in a limiting sense, but is made merely for the purpose of illustrating the general principles of the invention, since the actual scope of the invention can be best determined by the appended claims.

Referring now to FIG. 1, there is shown an apparatus 100 which includes an outer housing 110 and an inner housing 150. The outer housing includes a cylindrical casing 112, a first head or end plate 114 attached to one end of the casing, and a second head plate 116 attached to the opposite end of the casing. A shaft 118 is supported on the head plate 114, and includes a stem portion extending away from the head plate 114 substantially normal thereto in the direction of the longitudinal axis L—L of the cylindrical casing 112.

A first, "primary", gear 122 (see FIGS. 2 and 4) is formed on one end of the shaft 118. The opposite end of the shaft is configured for a secure fit in an opening disposed in or extending through the head plate 114. The secure fit can be accomplished by a press fit process, a heat shrinkage treatment, by providing a key on the shaft and a keyway in the side of the opening, by a welding process, etc.

A plurality of through holes 121 are arranged about the circumference of the head plate 114 (see FIG. 1) and the head plate 116 (see FIG. 2). Bolts 124, comprising heads and threaded shanks, are inserted in the through holes 121, and pushed through the head plate so that the heads of the bolts seat atop the holes 121 of the head plate, and the shanks of the bolts engage in similarly positioned threaded holes 123 in respective ends of the casing 112. When the end plates are secured on the ends of the cylindrical outer housing 112, seals or gaskets are secured between the respective surfaces of the outer housing which mate with the end plates 114 and 116.

The end plates also include four ports or openings (see FIG. 1). Ports 115*a*, 115*a*' are intake ports; ports 115*b*, 115*b*' are exhaust ports.

The inner housing 150 comprises a crank case assembly within which the cylinders 154 and pistons 156 are supported. FIG. 1 shows the crank case assembly as including two substantially identical cylindrical members 158, 158' disposed atop one another and in substantially face-to-face, abutting, relationship. The cylinders 154 are supported by the crank case assembly such that the cylinders are arranged substantially parallel to, and equidistantly spaced from, one another. Preferably, the cylinders are disposed at a predetermined radius from the center of the crank case which provides, along with other operating parameters to be described below, optimum efficiency of operation for the pump when in operation.

In an alternative construction of the crank case assembly, the two cylindrical members could be fashioned as a single element with a hollow interior so that the internal components could be placed inside.

The periphery of each cylindrical member of the crank case assembly has a cylindrical wall, and as shown in FIG. 1, the cylindrical wall is provided with equidistantly spaced, semi-circular, openings 159, 159'.

FIG. 2 is a cross-sectional view of the inner and outer housings of the pump assembly looking at the internal structural configuration at the level of the openings 159. FIG. 2 shows the inner housing 150 mounted on the shaft 118 at a location just below the primary gear 122 of the outer housing 110. A bearing 170 is provided between the shaft 118 and the crank case floor 172.

Figure 3:
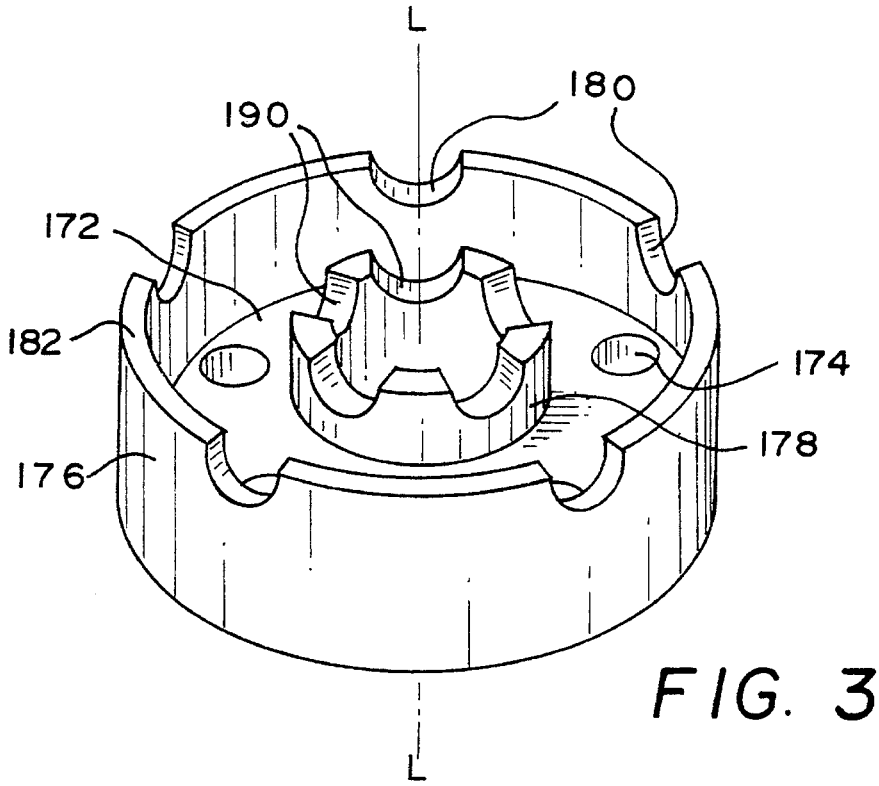
FIG. 3 is a perspective view of one crank case looking into its interior.

Referring briefly to FIG. 3, each crank case is seen to include a floor portion 172 of a given thickness which includes about its periphery a plurality of openings 174 for receiving and supporting the cylinders 154. The openings are preferably formed equidistantly apart about the periphery of the floor portion 172. Each crank case also includes outer and inner concentric walls 176, 178.

The openings 159 in the crank case assembly preferably comprise semi-circular regions of removed material on each of the crank case cylindrical members 158, 158'. The semi-circular regions constitute outer bearing journals 180 which are formed in the face surface 182 of the outer wall 176, and inner bearing journals 190 which are formed in the face surface 192 of the inner wall 178.

As seen in FIG. 3, the outer and inner bearing journals 180, 190 are radially aligned and constitute, when considered as a pair, a support for rotation of the crank member bearings 204 and 202, respectively (described below).

Each of the crank members 200 (refer to FIGS. 2, 4 and 5) comprise an inner bearing 202 formed on a shaft 206 and an outer bearing 204. A secondary gear 208 is formed on the inner end of the crank member shaft 206. The crank member also includes a pair of plates 210, 212 which are parallel to one another and to the longitudinal axis L—L of the outer housing. The bearing 204 is connected to plate 212, while the bearing 206 is connected to the plate 210. One or more force transmitting elements 214 interconnect the two plates together. FIGS. 2 and 3 show the bearings 202, 204 of each crank member 200 as being supported by the inner and outer bearing journals 190 and 180, respectively. The force transmitting elements 214 extend normal to the plates at a location determined as a function of the piston stroke length.

Figure 4:
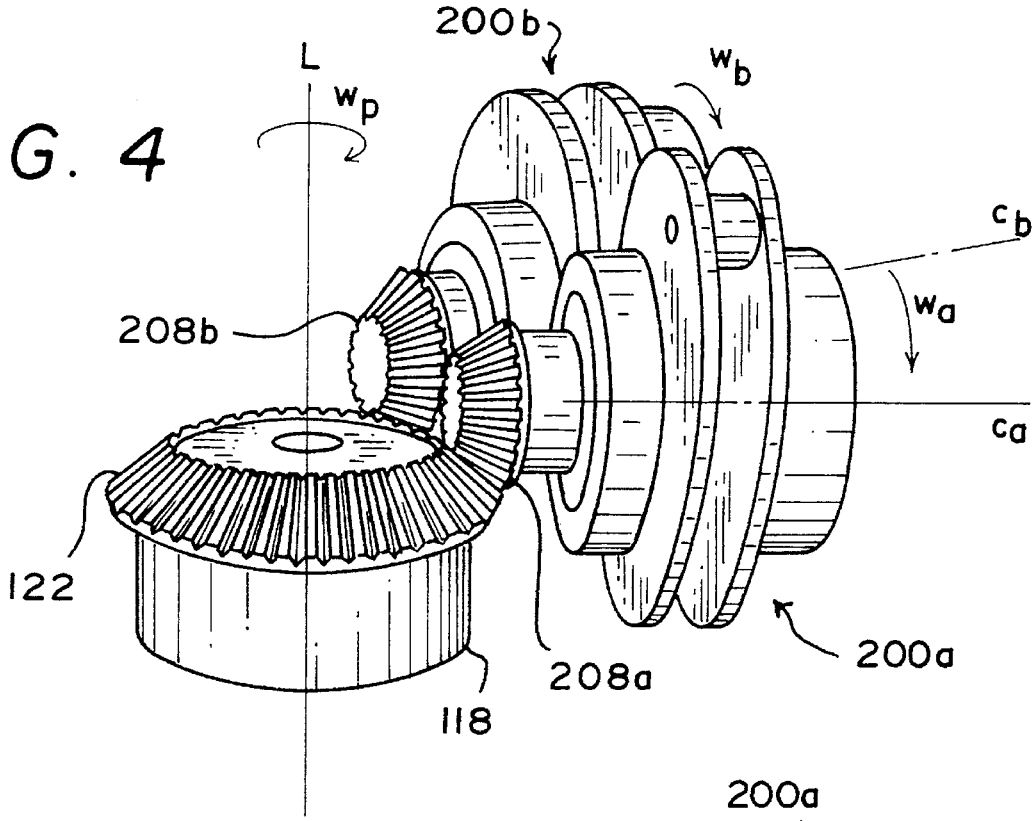
FIG. 4 is a perspective view of the primary gear and two adjacent secondary gears mounted thereon.
Figure 5:
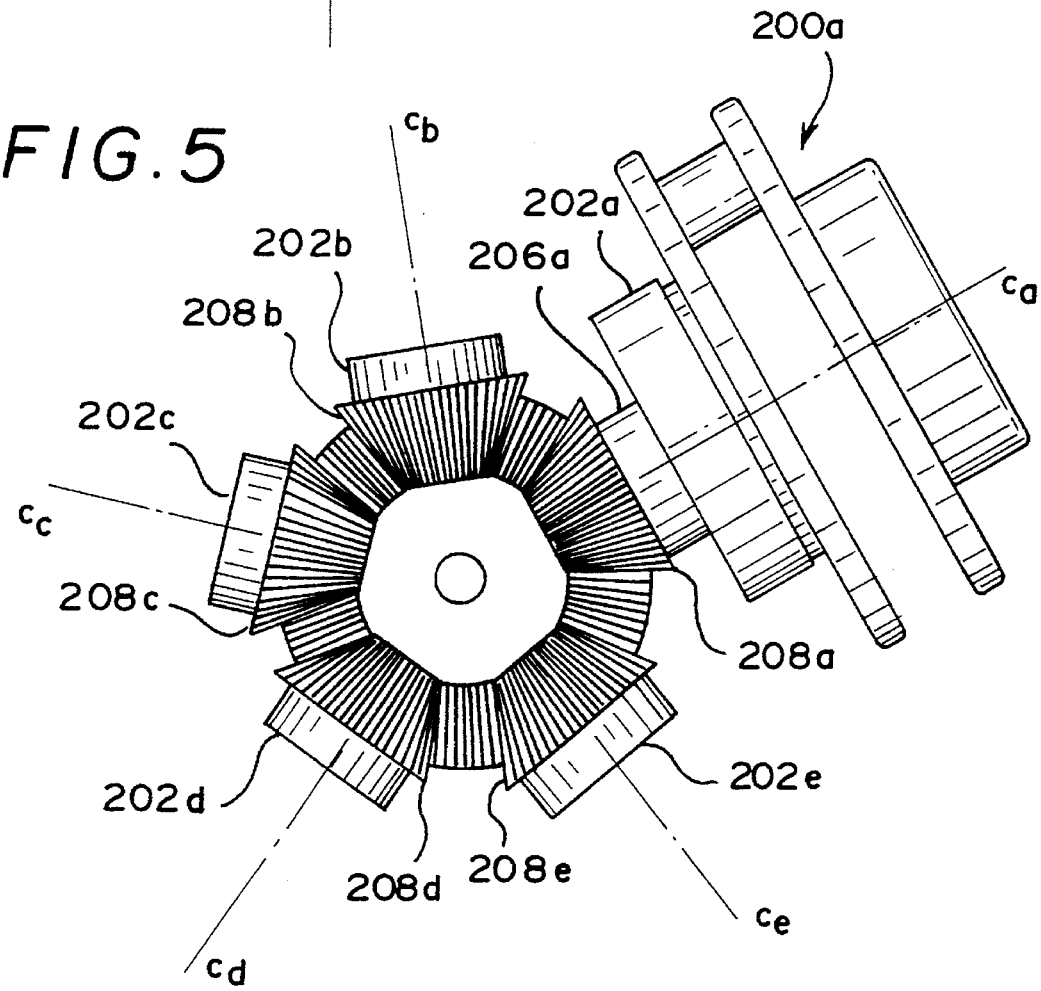
FIG. 5 is a top view of the primary and secondary gear arrangement.

FIGS. 4 and 5 show,the shaft 118 and the primary gear 122 disposed on the end of the shaft, as well as several secondary gears associated with the crank assembly. In the FIG. 4 perspective view, two such crank members 200*a* and 200*b* are shown, while in FIG. 5 there is shown a top view of the spatial relationship between the primary gear 122 and the secondary gears 208*a*, 208*b*, 208*c*, 208*d*, 208*e* with which the illustrated primary gear is designed to operate.

From FIG. 4, it can be seen that each crank member (two such crank members 200*a* and 200*b* are shown here) rotates about its own axis; crank member 200*a* rotates about axis $C_a$ with a rotational speed $W_a$, while crank member 200*b* rotates about axis $C_b$ with a rotational speed of $W_b$. The two crank members shown are positioned adjacent one another, with the secondary gears of both of the crank members being supported by and engaging the primary gear 122. The number of crank member secondary gears which can be supported on the primary gear is a function of the diameter of the primary gear, and the length and diameter of the crank member shaft 206.

FIG. 5 shows five secondary gears (associated with five distinct crank members) mounted on the primary gear 122. Each of the secondary gears will rotate about the respective axis of rotation $C_i$ of that crank member. As a result of the size of the primary and secondary gears, and the size of the length and diameter of the shaft 206 of each of the crank members, the group of crank members supported on the primary gear 122 will rotate about the primary gear with a rotation speed of $W_p$.

Each crank member 200*a*, 200*b*, . . . exhibits an axis of symmetry for all of the shaft portions and plate members with the exception of the force transmitting element 214 which is located at a distance chosen as a function of the piston stroke length. The axis of symmetry $C_i$ of each crank member is preferably maintained substantially normal to the longitudinal axis L—L of the primary gear.

FIGS. 6 and 7 show, the piston 300 which is used in the pump of the present invention. The piston is seen to include an inner or central body portion 302, medial portions 304 disposed outwardly of the central body portion 302, and a piston portion 306 disposed outwardly of (at the outermost end of) the medial portions.

Preferably, the piston portions 306 have a shape which is congruent with the shape of the cylinder. For example, if the cylinder is of conventional cylindrical shape, then the piston portion needs to be of conventional cylindrical shape. On the other hand, if the cylinder has a polygonal shape (e.g., a rectangle or hexagon), then the piston portion should also have the same polygonal shape.

The central body portion and the medial portions should preferably have the same width and thickness; however, this is not essential insofar as the particular design could dictate that there be differences in these parameters. The width of the piston rod is preferably large enough to accommodate a full range of motion of the crank member force transmitting element.

A slot 308 is formed in the body portion 302 which extends entirely through its thickness. The slot, as shown in FIGS. 6 and 7, is located in the central region of the body portion 302 and extends in a direction normal to the longitudinal axis of the piston as well as the longitudinal axis of the crank member C—C.

The slot is located at the position shown primarily for balance, and is designed to capture and engage the force transmitting element 214. The slot 308 is of such a width that the force transmitting element sits snugly between opposite sides of the slot. In addition, the length of the slot must be great enough to allow the force transmitting element to move twice the radial distance measured from the longitudinal axis C—C of the crank member with which it is associated.

While the central and medial portions of the piston may not possess the same diameter as the cylinder with which they are associated, the thickness and width of the piston portions 306 must be of a diameter or other dimension (e.g., if the cylinder is other than cylindrical, as for example, of a polygonal shape) that will enable the outer walls of the piston portion to ride as closely as possible along the inner wall of the cylinder without the two walls touching.

The secondary gears 208*a*–208*c* carried by the their respective crank members turn about the crank axes of symmetry C—C while also rotating about the longitudinal axis L—L of the inner housing on the primary gear 122. Since the crank members are constrained by the crank case, as the secondary gears rotate, the entire crank case and set of secondary gears also rotate about the longitudinal axis L—L.

Referring once again to FIG. 2, the manner in which the piston central portion 302 and the force transmitting element 214 are connected is shown. The force transmitting element is seen to extend substantially normal to the plates and span the distance therebetween. FIG. 2 also shows the force transmitting element engaged within the slot formed in the central portion of the piston.

The present invention contemplates the force transmitting member 214 being fixedly or rotatably supported on a pin or shaft interconnecting and spanning the plate members 210 and 212.

Each of the pistons 300 are constrained or supported for reciprocating linear motion within a respective cylinder in a direction along the cylinder longitudinal axis (i.e., parallel to the longitudinal axis L—L).

With the force transmitting member 214 held in the central portion slot, as the plates (and hence the force transmitting element) of the crank member 200 rotate about the crank shaft axis C—C, the force transmitting element imparts a force F on one side of the slot in a direction parallel to the longitudinal axis of the piston. Because the piston is constrained for linear movement within and by the cylinder in a direction parallel to the axis L—L, the force F causes the piston to move linearly within its constraints.

In other words, the crank members and the force transmitting elements on the crank members are the "linch pins" responsible for converting the rotational movement of the outer housing into linear or translational motion of the pistons. When the external torque is applied to the outer housing, the primary gear 122 rotates causing rotation of the secondary gears. This in turn causes the rotation of the plates and the force transmitting element about the axis C—C of the crank member.

The operation of the apparatus described above now follows. This description pertains to an embodiment of the pump such as is shown in the Figures. The embodiment shown includes five cylinders, pistons, crank members. The invention contemplates any number of cylinders, pistons and crank member sets designed to fit within the inner housing.

Each of the five crank members in the pump shown in the Figures includes a secondary gear 208 that is coupled with the centrally located primary gear 118. An external source of torque (not shown) is connected to a shaft 142 supported by the end plate 116 (see FIG. 1). The external source of torque can be a rotary power source, such as an electric, a gas, or a pneumatic, motor.

The shaft 142 is supported for rotation within a housing 143. A collar 144, which is a part of the end plate 116, engages the housing 143. A key 146 on the housing and a keyway 145 on the collar insure that the collar and the housing make a secure, tight fit. The shaft 142 extends along the longitudinal axis L—L of the pump and preferably runs through the entire length of the pump from the primary gear 118 to and beyond the end plate 116. As a result of this arrangement, the primary gear 122 drives the crank case assembly in rotation about the longitudinal axis L—L of the outer housing 110 through rotation of the secondary gears 208 (associated with the crank members 200) about the axis L—L due to their engagement with the primary gear 122.

As the crank member rotates, the force transmitting element circumscribes a circular path, but nevertheless travels the path while constrained in the slot 308 of the piston. Thus, although the force transmitting element travels in a circular motion, it imparts a component of force to the central portion of the piston, thereby causing the latter to move in a linear, reciprocating manner.

The pump apparatus depicted in the drawings utilizes a 2:1 gear ratio between the primary and secondary gears. Thus, each piston will translate through two peaks ("top dead centers") and two valleys ("bottom dead centers").

Since each piston is double-ended, it is double-acting. Thus, when one face of the piston is at top dead center, the other face of the same piston is at bottom dead center. The pump therefore essentially operates at both ends with an equivalent "per rotation" performance of 20 single positive displacement piston pumps.

For each rotation per side (or end) of the pump, the pistons perform two intake cycles and two exhaust cycles. As each piston passes an intake port 115*a* or 115*b* in the end plate 116, the motion of the piston toward the other end plate produces a suction which pulls fluid from an adjacent fluid reservoir into the cylinder cavity adjacent the end plate 116. At the end of that stroke, the piston begins to move back toward the end plate 116 just as the leading edge of the filled cylinder meets the trailing edge of one of the exhaust ports 115*a*', 115*b*'. With this movement of the piston, the fluid is progressively discharged to an exhaust port connected with a manifold (not shown).

Insofar as there are two intake ports and two exhaust ports located in each end plate of the pump apparatus, the present invention is capable of providing the equivalent of a 20-cylinder pump.

While the present, invention has been described in conjunction with specific embodiments thereof, it is evident that many alternatives, modifications, and variations will be apparent to those skilled in the art in light of the foregoing description. Accordingly, the present invention is intended to embrace all alternatives, modifications, and variations which fall within the spirit and scope of the appended claims.

What I claim is:

1. A fluid pump, comprising:

a closed first housing, pistons in said first housing supported for reciprocating linear motion in a first direction, crank means in said first housing supported for rotation about an axis normal to said first direction, gear means in said first housing and on said crank means, said first housing gear means engaging the gear means of said crank means to impart rotational motion to the latter in response to rotational motion of the former, force transmitting means, supported on said crank means, for coupling said pistons with said crank means, whereby rotational motion of said crank means about said second axis is converted into reciprocating motion of said pistons in a direction substantially parallel to said first axis, said crank means and said pistons being supported in a second housing, said second housing being supported within said first housing for rotation about said first direction.

2. The fluid pump of claim 1, wherein the number of said pistons are five.

3. The fluid pump of claim 1, and further including intake and exhaust ports at opposite ends of said first housing, wherein said pistons are supported in said second housing and are double-ended, said pistons providing two cycles of pumping action at both ends of said cylinders for each revolution of said second housing about said first direction.

4. A fluid pump, comprising:

a closed first housing, pistons in said first housing supported for reciprocating linear motion in a first direction, crank means in said first housing supported for rotation about an axis normal to said first direction, gear means in said first housing and on said crank means, said first housing gear means engaging the gear means of said crank means to impart rotational motion to the latter in response to rotational motion of the former, force transmitting means, supported on said crank means, for coupling said pistons with said crank means, whereby rotational motion of said crank means about said second axis is converted into reciprocating motion of said pistons in a direction substantially parallel to said first axis, each of said crank means including spaced plate members interconnected by said force transmitting means, and each of said pistons includes a slot, and further wherein said force transmitting means engages in said slot and has its motion constrained by said slot.

5. The fluid pump of claim 4, wherein the motion of said force transmitting means is circular, and said slot is disposed perpendicular to said first direction, whereby when said force transmitting means moves in said circular motion, said piston moves in said reciprocating linear motion.

6. The fluid pump of claim 4, wherein said piston is disposed between said plate members, and said force transmitting means is spaced from said crank means axis.

7. A fluid pump, comprising:

a first housing having a longitudinal axis and end plates covering opposite ends of said housing, torque input means coupled with one of said end plates, primary gear means supported by the other end plate and extending longitudinally into said first housing, a second housing disposed within said first housing and supported for rotation about said longitudinal axis, said second housing including equidistantly spaced hollow portions arranged parallel to said longitudinal axis in such a manner that the ends of said hollow portions are located adjacent said end plates, crank means, carried by said second housing, having secondary gears means, said secondary gear means being engaged with said primary gear means so that rotation of said second housing about said longitudinal axis causes rotation of said crank means about a second axis which is substantially perpendicular to said longitudinal axis, said crank means further including a second portion extending along said second axis and including camming means, piston means supported for reciprocation within each of said hollow portions, said piston means including means for engaging said camming means on said crank means second portion, and means for coupling the rotational motion of said second housing to said shaft means carried by said first housing.

8. The fluid pump of claim 7, wherein the diameter of said primary gear means is effectively twice the diameter of said secondary gear means.

9. The fluid pump of claim 1, wherein said camming means of said crank means comprises a force transmitting element spanning parallel plates, and further wherein said piston means for engaging said camming means on said crank means is located in a central portion of said piston means.

10. The fluid pump of claim 9, wherein said piston means for engaging said camming means on said crank means comprises a slot in said central portion, said slot being disposed in a direction normal to both said first and second axes of rotation.

11. The fluid pump of claim 10, wherein said force transmitting element is disposed in said slot, and the motion of said force transmitting element is circular while the motion of the slot is linear.

12. The fluid pump of claim 7, wherein said second housing includes a pair of cylindrical crank case members, one of said crank case members being disposed in an inverted, face-to-face, relationship with the other of said crank case members.

13. The fluid pump of claim 12, wherein each of said crank case members comprises an outer wall and an inner wall concentrically located within said outer wall, and further wherein said inner and outer walls comprise bearing journals for supporting portions of said crank means, whereby said crank means are supported for rotation about said second axis.

14. The fluid pump of claim 12, wherein each of said crank case members includes a floor portion from which inner and outer cylindrical walls extend, said floor portion having openings therethrough defining said hollow portions.

15. The fluid pump of claim 14, wherein said openings are formed in said floor portion between said inner and outer cylindrical walls.

16. The fluid pump of claim 14, wherein said openings are formed without using off-axis milling.

* * * * *